United States Patent [19]

Salik et al.

[11] Patent Number: 4,704,168

[45] Date of Patent: Nov. 3, 1987

[54] ION-BEAM NITRIDING OF STEELS

[75] Inventors: Joshua Salik, Shaker Heights; Theodore E. Hubbell, Cleveland, both of Ohio

[73] Assignee: The United States of America as represented by the Administrator of the National Aeronautics and Space Administration, Washington, D.C.

[21] Appl. No.: 823,713

[22] Filed: Jan. 29, 1986

Related U.S. Application Data

[63] Continuation-in-part of Ser. No. 661,481, Oct. 16, 1984, abandoned.

[51] Int. Cl.[4] ..... C21D 1/48

[52] U.S. Cl. ..... 148/16.6; 204/192.31; 427/38

[58] Field of Search ..... 148/4, 16.6; 204/192 N; 427/38

[56] References Cited

U.S. PATENT DOCUMENTS

| | | | |
|---|---|---|---|
| 3,341,352 | 9/1967 | Ehlers | 427/38 |
| 3,832,219 | 8/1974 | Nelson et al. | 204/192 N |
| 3,900,636 | 8/1975 | Curry et al. | 148/4 |
| 4,105,443 | 8/1978 | Dearnaley et al. | 75/238 |
| 4,250,009 | 2/1981 | Cuomo et al. | 204/192 N |

OTHER PUBLICATIONS

Weissmantel et al, "Preparation of Hard Coatings by Ion Beam Methods", Thin Solid Films 63 (1979), pp. 315–325.

Jindal, "Ion Nitriding of Steels", J. Vac. Sci. Technol. 15(2) Mar./Apr., pp. 313–317.

Salik, Joshua, "Ion-Beam Nitriding of Steels", J. Appl. Phys. 57(4), Feb. 15, 1985, pp. 1328–1331.

*Primary Examiner*—John P. Sheehan

*Attorney, Agent, or Firm*—Gene E. Shook; John R. Manning

[57] ABSTRACT

A surface of a steel substrate is nitrided without external heating by exposing it to a beam of nitrogen ions under a low pressure. The pressure is much lower than that employed for ion-nitriding, and an ion source is used instead of a glow discharge. Both of these features reduce the introduction of impurities into the substrate surface.

3 Claims, 5 Drawing Figures

ION-BEAM NITRIDING OF STEELS

ORIGIN OF THE INVENTION

The invention described herein was made by an employee of the U.S. Government together with an employee of the National Research Council and is subject to the provisions of Section 305 of the National Aeronautics and Space Act of 1958, Public Law 85-568 (72 Stat. 435, 42 USC 2457).

STATEMENT OF COPENDENCY

This application is a continuation-in-part of copending application Ser. No. 661,481 which was filed Oct. 16, 1984, now abandoned.

TECHNICAL FIELD

This invention is concerned with using an ion beam for surface nitriding of steel. Nitriding is a well established surface treatment used extensively in the metal industry for increasing the hardness, fatigue life, and wear resistance of steel without sacrificing bulk properties.

In the prior art this treatment was performed by chemical processes which utilize either a molten salt bath or reactive gases at high temperatures of about 540° C. These chemical processes are costly as well as time-consuming.

The disadvantages of conventional nitriding processes led to the development of an alternative process called ion-nitriding. This process is accomplished in a vacuum chamber at a pressure of several Torrs of the nitriding gas which is usually a mixture of nitrogen and hydrogen. A voltage which is either rf or negative dc is applied to the workpiece, thereby causing a discharge which results in nitriding of the workpiece. This process decreases the cost, and the process time is reduced from about 20 hours to about 6 hours.

Although ion-nitriding has provided some advantages over conventional nitriding of steel, certain problems have been encountered. More particularly, undesirable impurities have been introduced into the workpiece. Also, the combination of relatively high hydrogen partial pressure with an elevated workpiece temperature may cause diffusion of hydrogen into the workpiece with the detrimental results of embrittlement.

A discharge instability problem has been encountered in ionnitriding because the process is carried out in the region of abnormal glow discharge where voltage and current increase simultaneously, thus tending to change into arc discharge. Inasmuch as arc discharge is concentrated around isolated spots, overheating may result. This produces melting which damages the workpiece.

It is, therefore, an object of the present invention to provide an improved process for surface nitriding of steels utilizing an ion beam wherein the beam voltage and current are controlled independently to reach optimal conditions without external heating of the steel substrate. This is not possible in ion nitriding where current and voltage are interdependent at a given pressure.

Another object of the invention is to accomplish surface nitriding by using ion beams which avoid discharge instability problems often encountered in ion nitriding resulting in arcs concentrated around isolated spots that bring about overheating and damaged workpieces.

BACKGROUND ART

U.S. Pat. No. 3,341,352 to Ehlers relates to a process for treating metallic surfaces with an ion beam for coloring purposes. The metals treated with nitrogen ions are aluminum, copper, titanium, magnesium, and beryllium.

U.S. Pat. No. 4,105,443 to Dearnaley et al relates to the ion implantation of cemented carbides with nitrogen. This is a physical process of implantation not involving any chemical reaction.

U.S. Pat. No. 4,250,009 to Cuomo et al relates to a process of sputtering to deposit a plurality of metals upon a substrate. The composition of the resulting film is varied in accordance with externally applied control inputs. This patent describes an ion source designed for the deposition of thin films.

DISCLOSURE OF THE INVENTION

According to the present invention a steel workpiece is exposed to a beam of nitrogen ions under low pressure. The process is carried out in a vacuum system in a nitrogen atmosphere at a pressure of about $3\times10^{-4}$ Torr. This is four orders of magnitude lower than that employed for ion-nitriding. This low pressure has the beneficial technical effect of reducing the introduction of undesirable impurities from the gas phase into the workpiece.

The production of ions in accordance with the present invention is accomplished by using an ion source rather than by a discharge throughout the chamber as in the case of ion nitriding. This reduces the introduction of impurities into the unheated workpiece.

BRIEF DESCRIPTION OF THE DRAWINGS

The objects, advantages and novel features of the invention will be more fully apparent from the following detailed description when read in connection with the accompanying drawings in which.

BEST MODE FOR CARRYING OUT THE INVENTION

Figure 1:
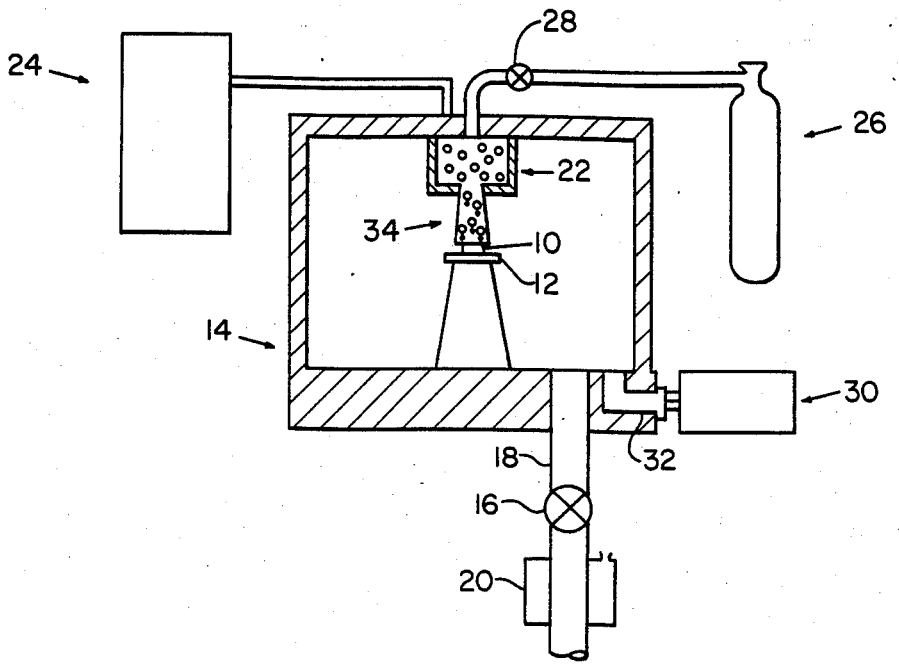
FIG. 1 is a schematic view of apparatus used to conduct the process of the present invention.

Referring now to the drawings there is shown in FIG. 1 an ion beam system for performing the process of the present invention. A steel workpiece 10 which is to be nitrided is supported by a suitable holder 12 in a vacuum chamber 14. The interior of the chamber 14 is placed in communication with a diffusion pump (not shown) by a valve 16 in an evacuation line 18. A suitable liquid nitrogen trap 20 is provided in the line 18.

An ion source 22 is mounted within the vacuum chamber 14. A suitable power supply and control unit 24 is connected to the ion source 22. Nitrogen gas from a source 26 is supplied to the ion source 22 through a valve 28.

Nitrogen ions are generated in the source 22 by a magnetically assisted discharge and accelerated by the beam voltage towards the workpiece 10. This is in contrast to ion nitriding where ions are generated by discharge throughout the whole chamber thereby sputter etching many parts of the system.

The pressure within the chamber 14 is monitored by a pressure indicator 30 connected to an ion gage 32. Satisfactory results have been obtained when the pressure within the chamber is reduced to about $3\times10^{-4}$ Torr.

The nitridability of steel depends on its alloy content. Although most steels are capable of yielding iron nitride if exposed to nitrogen at suitable temperatures, optimum results are obtained with steels which contain one or more of the nitride-forming alloy elements. Among the common alloy elements the strongest nitride formers are aluminum, chromium, molybdenum and vanadium.

Two types of steel containing different nitride forming elements were nitrided in accordance with the present invention. The first was a workpiece of a super nitralloy having a nominal weight percent composition of 2.06% Al, 0.58% Cr, 5.16% Ni, 0.24% C, 0.25% Mn, 0.22% Si, 0.26% Mo, 0.12% V, 0.005% P, 0.003% S, and the balance Fe. This super nitralloy is a grade specifically manufactured for nitriding in which the nitride forming element is aluminum.

The second was a workpiece of 304 stainless steel having a nominal weight percent composition of 18-20% Cr, 8-12% Ni, 0.08% (max) C, 2.00% (max) Mn, 1.0% Si, 0.045% (max) P, 0.03% (max) S, and the balance Fe. In this 304 stainless steel the nitride forming element is chromium.

After the workpiece 10 is mounted in the vacuum chamber 14 the interior is evacuated through the valve 16 while the workpiece remains at ambient temperature. The ion source 22 is actuated by the control unit 24. Nitrogen is supplied to the ion source 22 from the supply 26, and the resulting ion beam 34 strikes the surface of the workpiece 10. Satisfactory results have been obtained with ion beams having energies between 0.5 keV and 1.5 keV. The result of the chemical reaction between nitrogen ions and some of the alloying elements in the steel workpiece is a case hardening of the surface to a depth of about 150 $\mu$m.

Figure 2:
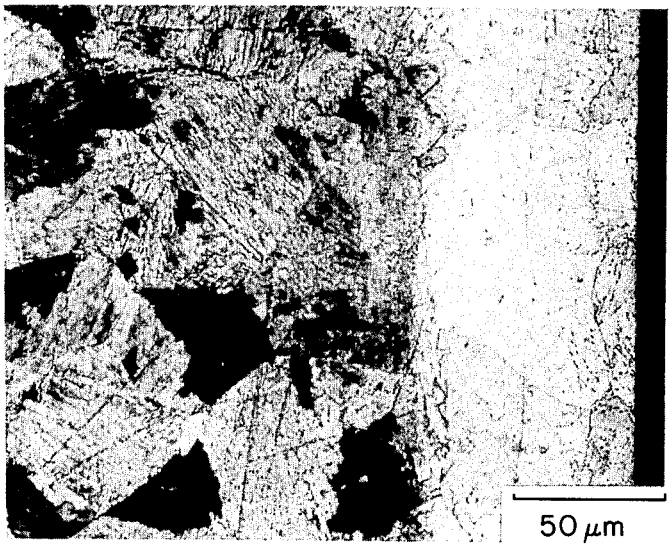
FIG. 2 is a metallgraphic cross-section of a super nitralloy nitrided with an ion beam at 1000 V, 30 mA for 50 minutes.
Figure 3:
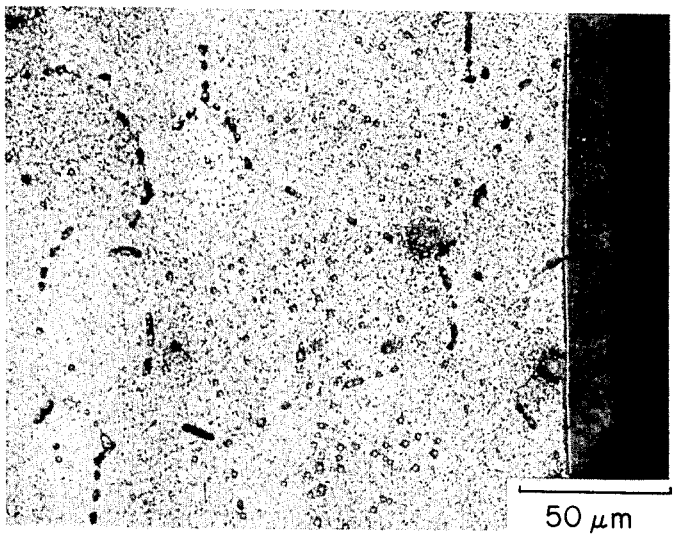
FIG. 3 is a metallgraphic cross-section of a 304 stainless steel nitrided with an ion beam at 1000 V, 30 mA for 50 minutes.

Metallographic cross-sections of the two types of steel are shown in FIGS. 2 and 3. Referring to the 304 stainless steel shown in FIG. 3 the interface between the nitrided layer and the core is sharp, and the nitrided layer is shallow and brittle. However, this is not unique to the present invention in that it occurs for steels containing more than 5 weight percent chromium in both conventiinal and ion nitriding.

Again referring to FIGS. 2 and 3 the compound layer usually observed in conventionally and ion nitrided steels is absent. This may result from sputtering of the layer by the ion beam 34.

The microhardness of the nitrided surfaces of both types of steels was measured by a Vickers tester with a load of 500 gm. The results obtained for the two types of steel under different conditions are shown in FIGS. 4 and 5.

Figure 4:
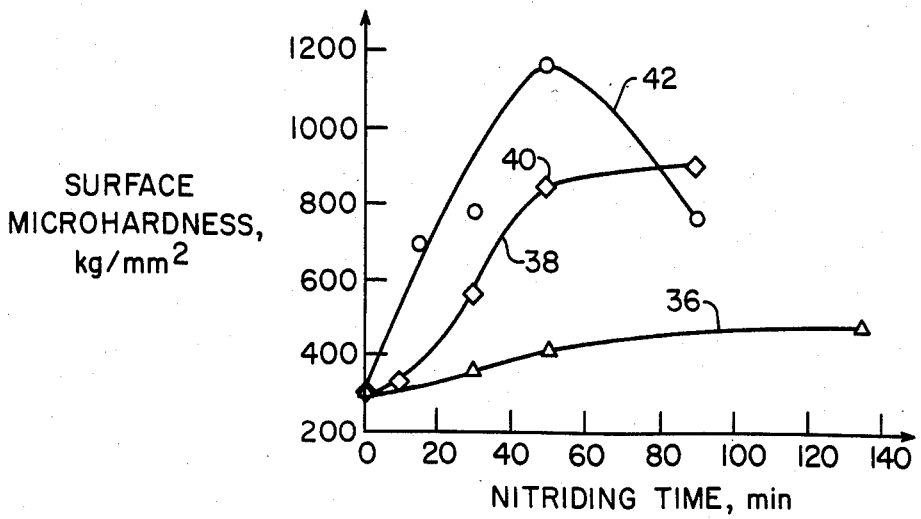
FIG. 4 is a graph showing surface microhardness plotted as a function of nitriding time of super nitralloy nitrided by ion beams under various conditions.

Referring to FIG. 4 the curve 36 shows the surface microhardness in kg/mm$^2$ of super nitralloy plotted as a function of nitriding time in minutes nitrided by a 1500 V, 15 mA ion beam. The curve 38 shows the surface microhardness of the same steel nitrided by a 1000 V, 30 mA ion beam. The point 40 on the curve 38 illustrates the beam used to nitride the super nitralloy shown in the metallgraphic cross-section of FIG. 2. The curve 42 represents a 1500 V, 30 mA ion beam.

Figure 5:
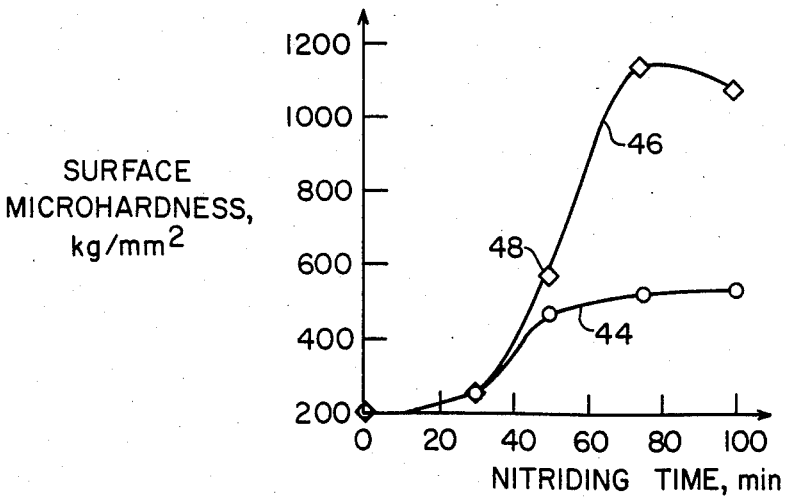
FIG. 5 is a graph showing surface microhardness plotted as a function of nitriding time of 304 stainless steel nitrided by ion beams under various conditions.

In FIG. 5 the curve 44 shows the surface microhardness in kg/mm$^2$ of 304 stainless steel plotted as a function of nitriding time in minutes nitrided by a 1500 V, 30 mA ion beam. The curve 46 shows the surface microhardness of the same steel nitrided by a 1000 V, 30 mA ion beam. The point 48 on the curve 46 illustrates the beam used to nitride the 304 stainless steel shown in the metallgraphic cross-section of FIG. 3.

It is apparent that with increasing processing time the hardness first increases, reaches a maximum, and then decreases. Another striking feature of the results is the different effect of beam voltage on the surface-microhardness attained with the two types of materials.

While the preferred embodiment of the invention has been shown and described, it will be apparent that various modifications may be made to the invention without departing from the spirit thereof or the scope of the subjoined claims.

We claim:

1. In a method of forming a nitrided layer without a compound layer on a surface of a steel substrate selected from the group consisting essentially of super nitralloys and stainless steels, the improvement comprising positioning said substrate in a vacuum chamber at ambient temperature, reducing the pressure in said chamber to about $3\times10^{-4}$ Torr, striking said surface with a beam of nitrogen ions having energies between about 0.5 keV and about 1.5 keV within said chamber in the absence of a discharge, and independently controlling the voltage and current of said ions to maintain said beam thereby forming said nitrided layer without external heating of said steel substrate.

2. A method of nitriding as claimed in claim 1 wherein the substrate is a super nitralloy and the nitrogen ions strike the surface about 50 minutes.

3. A method of nitriding as claimed in claim 1 wherein the substrate is a stainless steel and the nitrogen ions strike the surface for about 70 minutes.

* * * * *